US009347144B2

(12) United States Patent
Chapaneri et al.

(10) Patent No.: US 9,347,144 B2
(45) Date of Patent: May 24, 2016

(54) DARK COLORED CHROMIUM BASED ELECTRODEPOSITS

(76) Inventors: Roshan V. Chapaneri, Coventry (GB); Richard G. Tooth, West Midlands (GB); Roderick D. Herdman, Staffordshire (GB); Stacey L. Handy, West Midlands (GB)

( * ) Notice: Subject to any disclaimer, the term of this patent is extended or adjusted under 35 U.S.C. 154(b) by 898 days.

(21) Appl. No.: 13/593,690

(22) Filed: Aug. 24, 2012

(65) Prior Publication Data

US 2012/0312694 A1 Dec. 13, 2012

Related U.S. Application Data

(62) Division of application No. 12/940,249, filed on Nov. 5, 2010, now Pat. No. 8,273,235.

(51) Int. Cl.

| | |
|---|---|
| ***C25D 15/00*** | (2006.01) |
| ***C25D 3/56*** | (2006.01) |
| ***C25D 3/04*** | (2006.01) |
| ***C25D 3/06*** | (2006.01) |
| ***C25D 3/08*** | (2006.01) |

(52) U.S. Cl.
CPC .. *C25D 3/06* (2013.01); *C25D 3/08* (2013.01); *C25D 15/00* (2013.01)

(58) Field of Classification Search
CPC ..... C25D 3/06
USPC ..... 205/283, 109, 287, 288, 243
See application file for complete search history.

(56) References Cited

U.S. PATENT DOCUMENTS

| | | | | |
|---|---|---|---|---|
| 3,954,574 | A | 5/1976 | Gyllenspetz et al. | |
| 4,054,494 | A | 10/1977 | Gyllenspetz et al. | |
| 4,141,803 | A | 2/1979 | Barclay et al. | |
| 4,161,432 | A | 7/1979 | Barclay et al. | |
| 4,278,512 | A * | 7/1981 | Barclay et al. | 205/179 |
| 4,502,927 | A | 3/1985 | Barclay et al. | |
| 5,196,109 | A | 3/1993 | Scott | |
| 5,294,326 | A | 3/1994 | Shahin | |
| 5,393,353 | A | 2/1995 | Bishop | |
| 5,415,702 | A | 5/1995 | Bishop et al. | |
| 2003/0190492 | A1 * | 10/2003 | Wada et al. | 428/659 |
| 2004/0170848 | A1 | 9/2004 | Ludwig et al. | |
| 2005/0284769 | A1 | 12/2005 | Edigaryan | |
| 2006/0118427 | A1 | 6/2006 | Edigaryan | |
| 2008/0102297 | A1 | 5/2008 | Wu et al. | |
| 2009/0020185 | A1 * | 1/2009 | Inoue | 148/250 |

FOREIGN PATENT DOCUMENTS

| | | | | |
|---|---|---|---|---|
| EP | 1 484 432 | | 12/2004 | |
| EP | 1484432 | A1 * | 12/2004 | C23C 22/53 |
| WO | 2004/097069 | | 11/2004 | |
| WO | 2007/100135 | | 9/2007 | |
| WO | WO 2007100135 | A1 * | 9/2007 | C23C 22/53 |
| WO | 2010/035819 | | 4/2010 | |

* cited by examiner

*Primary Examiner* — Edna Wong

(74) *Attorney, Agent, or Firm* — Carmody Torrance Sandak & Hennessey LLP

(57) ABSTRACT

An aqueous acidic trivalent chromium electrolyte comprising trivalent chromium ions and a complexing agent for maintaining the trivalent chromium ions in solution is provided in which the aqueous electrolyte comprises additives capable of producing a coating on a substrate having a desired dark hue. The additives typically comprise a dispersion of colloidal silica and an additional additive selected from thiocyanate ions and/or iron ions. The electrolyte is used in a method of producing the desired dark-hued decorative chromium coating on a substrate by electrodeposition.

11 Claims, No Drawings

DARK COLORED CHROMIUM BASED ELECTRODEPOSITS

CROSS REFERENCE TO RELATED APPLICATIONS

This application is a divisional of application Ser. No. 12/940,249, filed Nov. 5, 2010, now U.S. Pat. No. 8,273,235, the subject matter of which is incorporated by reference in its entirety.

FIELD OF THE INVENTION

The present invention relates generally to a method of producing dark colored chromium coatings by electrodeposition.

BACKGROUND OF THE INVENTION

Chromium plating is an electrochemical process that involves the electrodeposition of chromium onto a substrate from a chromium electrolyte. Two common types of chromium plating are hard chromium plating and decorative chromium plating. Hard chromium plating involves the application of a heavy coating of chromium onto steel substrates, typically to prevent wear, and exists in thicknesses in the range of about 10 to about 1000 μm. Decorative chromium plating applies a much thinner layer of chromium, in the range of about 0.25 to about 1.0 μm, and provides an extremely thin but hard coating for aesthetic purposes to achieve a shiny, reflective surface and/or protect against tarnish, corrosion and scratching of the metal beneath.

For decorative purposes, the chromium is generally applied over a coating of nickel. The chromium provides a hard, wear-resistant layer and excellent corrosion performance due to the chromium layer being cathodic with respect to the underlying nickel deposit. Thus, the underlying nickel layer becomes the anode in the corrosion cell and corrodes preferentially, leaving the chromium layer uncorroded.

Decorative chromium has traditionally been electroplated from electrolytes containing hexavalent chromium using, for example, an aqueous chromic acid bath prepared from chromic oxide ($CrO_3$) and sulfuric acid. However, electrolytes based on trivalent chromium ions have also been developed. The incentive to use electrolytes based on trivalent chromium salts arises because hexavalent chromium presents serious health and environmental hazards. In addition, hexavalent chromium ions and solutions from which they can be plated have technical limitations including the high cost of disposing of plating baths and rinse water. Furthermore, the operation of plating from baths containing substantially hexavalent chromium ion has operational limits which increase the probability of producing commercially unacceptable deposits.

Chromium deposits obtained from electrolytes based on hexavalent chromium are essentially pure chromium and have a uniform and invariant color. A thin oxide layer forms on the top of the coatings, providing a blue/white appearance. However, there is a market demand for coatings having a darker hue and it is desirable to develop electrolytes that are capable of producing coatings having a darker hue. A partial solution to this problem can be obtained by electrodepositing the chromium coatings from electrolytes based on trivalent chromium. However, the electrolytes based on trivalent chromium still produce coatings that are not dark enough to fill the needs of certain customers and a demand continues to exist for improved means of producing darker chromium based coatings.

SUMMARY OF THE INVENTION

It is an object of the present invention to develop chromium electrolytes capable of producing coatings with a desired dark hue on the underlying substrate.

It is another object of the present invention to identify additives for chromium electrolytes that can produce coatings having a desired darker hue.

It is still another object of the present invention to develop chromium electrolytes that incorporate a dispersion of colloidal silica therein, alone or in combination with other additives.

It is yet another object of the present invention to provide a method of plating trivalent chromium on a nickel substrate to obtain the desired effect using the chromium electrolyte solution described herein.

To that end, in a preferred embodiment the present invention relates generally to a method of producing a dark-hued decorative chromium coating on a substrate, the method comprising the steps of:

a) providing a trivalent Chromium electrolyte comprising trivalent chromium ions and a complexing agent for maintaining the trivalent chromium ions in solution, wherein the electrolyte comprises additives capable of producing a coating on a substrate having a desired dark hue, and b) electrodepositing chromium on the substrate using the electrolyte, wherein the dark-hued coating is produced on the substrate.

In addition, in another preferred embodiment, the present invention relates generally to an aqueous acidic trivalent chromium electrolyte comprising trivalent chromium ions and a complexing agent for maintaining the trivalent chromium ions in solution, wherein the aqueous electrolyte comprises additives capable of producing a coating on a substrate having a desired dark hue, said additives comprising colloidal silica and an additive selected from the group consisting of thiocyanate ions, iron ions, and combinations of thiocyanate ions and iron ions.

DETAILED DESCRIPTION OF THE PREFERRED EMBODIMENTS

The present invention relates to the development of trivalent chromium and chromium alloy electrolytes that are capable of producing dark-hued coatings on underlying substrates. More particularly, the present invention is directed to the use of various additives for trivalent chromium electrolytes that are capable of producing coatings having the desired dark hue. These additives may include colloidal silica, thiocyanates and co-deposited metals.

Chromium electrodeposits have long been valued for their decorative appearance, strength and resistance to corrosion. However, of all the metals which are widely used in the electroplating industry, chromium is anomalous in that it is not possible, readily, to plate it from solutions of simple chromium salts. Therefore, most trivalent chromium plating solutions are present as complexes of chromium, and the electrolyte typically comprises trivalent chromium ions and a complexing agent for maintaining the trivalent chromium ions in solution. Thus, one of the challenges when using a complex of chromium is to achieve a complex which is stable and at the same time bound loosely enough to permit plating, and to enable chromium to be precipitated from rinse waters sufficiently readily to permit economic purification of the effluent.

In a preferred embodiment, the present invention relates generally to a method of producing a dark-hued chromium coating on a substrate, the method comprising the steps of:

a) providing a trivalent chromium electrolyte comprising trivalent chromium ions and a complexing agent for maintaining the trivalent chromium ions in solution, wherein the electrolyte further comprises additives capable of producing a coating on a substrate having a desired dark hue, and b) electrodepositing chromium on the substrate using the electrolyte, wherein a dark-hued decorative coating is produced on the underlying substrate.

In addition, the present invention relates generally to an aqueous acidic trivalent chromium electrolyte comprising trivalent chromium ions and a complexing agent for maintaining the trivalent chromium ions in solution, wherein the aqueous electrolyte further comprises additives capable of producing a coating on a substrate having a desired dark hue, said additives comprising colloidal silica and an additive selected from the group consisting of thiocyanate ions, iron ions, and combinations of thiocyanate ions and iron ions.

Various trivalent chromium electrolytes comprising trivalent chromium ions and a complexing agent capable of maintaining the trivalent chromium ions in solution have been developed that are capable of producing a chromium coating on an underlying substrate.

For example, the chromium or chromium alloy electrolyte may comprise an aqueous solution of a chromium(III) complex and a buffer material, the buffer material may provide one of the ligands for the complex as described for example in U.S. Pat. Nos. 3,954,574 and 4,054,494 to Gyllenspetz et al., the subject matter of each of which is herein incorporated by reference in its entirety.

The buffer material is preferably an amino acid such as glycine ($NH_2CH_2COOH$) or peptides which are amino acid polymers. The amino acids are strong buffering agents, but also are able to form, during equilibration, complexes with metal ions, such as chromium(III), by coordination through their nitrogen or oxygen atoms. Thus by equilibrating an amino acid with a chromium(III) complex, mixed amino acid chromium(III) complexes are formed. Other buffer materials can also be used, including formates, acetates, borates etc.

Chromium(III) thiocyanate complexes may be used, such as chromium(III) sulfatothiocyante complexes or chromium (III) chlorothiocyanate complexes. In addition, by the addition of nickel, cobalt or other metal salts to the solution, alloys of chromium and these metals can be plated.

In another embodiment, the trivalent chromium electrolyte may be as described for example in U.S. Pat. Nos. 4,141,803 and 4,161,432 to Barclay et al., the subject matter of each which is herein incorporated by reference in its entirety. The chromium electrolyte comprises trivalent chromium in combination with a complexing agent. The solution is also at least substantially free from hexavalent chromium. The chromium electrolyte may include bromide, formate (or acetate) and any borate ion which may be present, as the sole anion species. Typically the solution contains only sufficient bromide to prevent substantial formation of hexavalent chromium, sufficient formate to be effective in complexing the chromium, and sufficient borate to be effective as a buffer, the remainder of the anions required to balance the cation content of the solution comprising cheaper species such as chloride and/or sulfate.

The electrolyte may contain halide ions, in addition to bromide such as fluoride or, preferably, chloride as well as some sulfate ions in a minor proportion based on the halide. The total amount of halide including the bromide and any iodide which may be present as well as any fluoride, and/or chloride, may optionally be sufficient, together with the formate and any borate to provide essentially the total anion content of the solution. The electrolyte may also contain the cations of the conductivity salts, and of any salts used to introduce the anion species. Optional ingredients include ammonium and co-depositable metals, such as iron, cobalt, nickel, manganese and tungsten. Non co-depositable metals may also optionally be present. Surface active agents and antifoams may also be present in effective and compatible amounts.

While examples of specific chromium electrolyte formulations are described above, the present invention is not limited to these particular chromium electrolytes and other trivalent chromium electrolyte solutions comprising a source of trivalent chromium ions and a complexing agent capable of maintaining the trivalent chromium ions in solution to which the colloidal silica and other additives may be added to produce the desired dark hued coating are also within the scope of the present invention.

The chromium electrolyte solutions described herein are typically used at temperatures between 15° C. and 65° C. Current densities between 5 and 1000 amps/$ft^2$, preferably between about 50 to 200 amps/$ft^2$ may be employed.

Best results are obtained when the bath is acidic, and preferably the pH is between about 1 and 4. At low pH values (below 2) there is some loss of covering power which becomes unacceptable below pH 1. If the pH is above 4 the rate of plating tends to be undesirably slow. Optimum pH is typically between 2 and 3.5.

The compositions described herein can provide a desired coating on plastics and nonferrous substrates as well as more conventional ferrous or nickel substrates. The invention is also preferably used on copper or its alloys.

When electroplating from electrolyte solutions described herein, inert anodes, such as carbon anodes, are typically used. Other inert anodes such as platinized titanium, platinum, iridium oxide coated titanium, or tantalum oxide coated titanium may also be used. Soluble chromium anodes are generally unsuitable due to the build up of hexavalent chromium. However, for certain alloy plating it may be possible to use ferrous metal or chromium/iron anodes.

As described herein, in order to produce the desired dark hued coating on the substrate, various additives are added to the chromium electrolyte formulation. The inventors of the present invention have found that the addition of colloidal silica particles, preferably as well as other additives, to the trivalent chromium electrolyte allows for coatings to be produced that are substantially darker than those obtained from the same electrolyte in the absence of these particles. Furthermore, the darkest coatings are obtained when the silica particles are added to electrolytes that have already been optimized to produce dark coatings by the incorporation of the other co-depositable metals as set forth above, particularly iron.

In a preferred embodiment, the additives capable of producing the desired dark hue comprise a dispersion of colloidal silica. Colloidal silica solutions may be obtained as aqueous dispersions of varying particle size distribution. The inventors of the present invention have found that good results can be obtained with dispersions having an average particle size of between about 1 and about 100 nm, more preferably with an average particle size of between about 10 and about 40 nm. Both anionic and cationic dispersions of silica have been found to be effective in compositions of the present invention. Suitable colloidal silicas include Ludox® TM40 available from Grace Davison, Bindzil 40/130 and Levasil 200 A/40% both available from Akzo Nobel Chemicals, and Nexsil 20 available from Nyacol Nano Technologies Inc. A concentration range of between about 0.5 and about 150 g/l, more preferably between about 1 and about 20 g/l of silica in the chromium plating bath has been found to be effective.

Furthermore, in addition to the dispersion of colloidal silica, the additives capable of producing the desired dark hue farther comprise thiocyanate ions, iron ions or a combination of thiocyanate ions and iron ions, and most preferably comprise thiocyanate ions. The concentration of thiocyanate ions in the chromium plating bath is preferably between about 0.2 and about 5 g/l, more preferably between about 0.5 and about 3 g/l. If used the concentration of iron ions in the chromium plating bath is preferably from 0.02 g/l to 2 g/l.

Dark hued coatings produced by the electrodeposition of chromium using the electrolytes described herein preferably have an L* value, measured according to an L*a*b* colorspace system, of less than 65, more preferably an L* value of less than 60, and most preferably an L* value of less than 54.

In a preferred embodiment, the substrate comprises a nickel or copper deposit on an underlying substrate and the chromium is plated on the nickel or copper deposit.

The following non-limiting examples illustrate the effectiveness of the composition of the present invention. All of the examples described below were prepared by plating brass Hull cell panels which had been coated with 10 microns of bright nickel deposit in a Hull Cell equipped with magnetic stirrer agitation.

In order to demonstrate the effectiveness of silica in the chromium electrolytes, a Konica Minolta CM2600d spectrophotometer was used to analyze the "lightness" values of the various examples by measuring the L* value according to the L*a*b* colorspace system. This gives a quantitative value (L*) which can be used to compare the degree of darkening obtained by the various combinations of additives (the higher the value, the lighter the deposit). An acceptable standard for measuring darkness is CIE S 014-4/E:2007/ISO11664-4 colorimetry-Part 4: CIE 1976 L*a*b* Colorspaces (Commission Internationale de L'Eslairage/1 Dec. 2008).

L* value represents the "lightness" of a sample and the value of L* is based on the percent of light reflectance on a scale of 0 to 100. If the L* value is 0, the sample is black, while if the L* value is 100, the sample is white. Any sample that falls somewhere between 0 and 100 reflectance is a variation of gray. If the L* value is closer to 0, the sample will be a darker gray while if the L* value is closer to 100, the sample will be a lighter gray. A standard calculation is performed to obtain the L* value. a* represents how green to red a sample is on a −60 to 60 scale with −60 being green and 60 being red. b* represents how blue to yellow a sample is on a scale of −60 to 60 with −60 being blue and 60 being yellow.

The electrolyte used in the examples as a standard was a commercial electrolyte designed to produce light colored chromium deposits (Macrome® CL3, available from MacDermid, Inc.). This electrolyte is based on the compositions described in U.S. Pat. Nos. 3,954,574 and 4,054,494 to Gyllenspetz et al., the subject matter of which is herein incorporated by reference in its entirety. In addition, as discussed above, the inventors of the present invention have also found that the addition of colloidal silica to electrolytes, such as those described in U.S. Pat. Nos. 4,141,803 and 4,161,432 to Barclay et al., the subject matter of each of which is herein incorporated by reference in its entirety, also yields beneficial results.

The following process conditions were utilized (except where explicitly stated

Temperature: 30° C.

pH: 2.8

Time: 5 minutes

Current: 5 amps

The lightness of the deposit was measured at a point on the Hull cell panel corresponding to a current density of 10 amps per square decimeter (asd) in all cases (40 mm from the high current density end of the panel).

COMPARATIVE EXAMPLE 1

A panel was plated using a standard chromium electroplating bath (Macrome® CL3, available from MacDermid, Inc.). The lightness of the deposit was measured and found to have an L* value of 78.12.

COMPARATIVE EXAMPLE 2

A panel was plated using a standard chromium electroplating bath (Macrome® CL3, available from MacDermid, Inc.) with the addition of 0.5 g/l of sodium thiocyanate. The lightness of the deposit was measured and found to have an L* value of 67.94 which indicates that the addition of thiocyanate ions can darken the deposit.

COMPARATIVE EXAMPLE 3

A panel was plated using a standard chromium electroplating bath (Macrome® CL3, available from MacDermid, Inc.) with the addition of 3 g/l of sodium thiocyanate. The lightness of the deposit was measured and. found to have an L* value of 62.4. This represents the darkest practical limit which can be obtained by the addition of thiocyanate. At higher concentrations of thiocyanate, the deposit properties are adversely affected and evolution of hydrogen sulfide during the deposition process becomes problematic.

EXAMPLE 1

A panel was plated using a standard chromium electroplating bath (Macrome® CL3, available from MacDermid, Inc.) with an addition of 20 ml/l of Ludox® TM40 (a 40% suspension of colloidal silica having an average particle size of 27 nm). The lightness of the deposit was measured and found to have an L* value of 64. This corresponds to a reduction in lightness of the deposit of 18% as compared with Comparative Example 1.

EXAMPLE 2

A panel was plated using a standard chromium electroplating bath (Macrome® CL3, available from MacDermid, Inc.) with an addition of 0.5 g/l sodium thiocyanate and 20 ml/l of Ludox® TM40 (a 40% suspension of colloidal silica having an average particle size of 27 nm). The lightness of the deposit was measured and found to have an L* value of 57.44. This corresponds to a reduction in lightness of the deposit of 15% as compared with Comparative Example 2.

EXAMPLE 3

A panel was plated using a standard chromium electroplating bath (Macrome® CL3, available from MacDermid, Inc.) with an addition of 3 g/l sodium thiocyanate and 20 of Ludox® TM40 (a 40% suspension of colloidal silica having an average particle size of 27 nm). The lightness of the deposit was measured and found to have an L* value of 53.79. This corresponds to a reduction in lightness of the deposit of 14% as compared with Comparative Example 3.

Thus, it can be seen from the above examples and comparative examples that the addition of colloidal silica gave a marked darkening of the deposit and that a combination of silica with thiocyanate provided a good result. In particular, the deposit that resulted from Example 3 yielded a very dark, lustrous and cosmetically attractive deposit with a much darker aspect than could be realized without the addition of silica.

It should also be understood that the following claims are intended to cover all of the generic and specific features of the invention described herein and all statements of the scope of the invention that as a matter of language might fall there between.

What is claimed is:

1. An aqueous acidic trivalent chromium electrolyte for electrodepositing chromium onto a substrate, the chromium electrolyte comprising trivalent chromium ions and a complexing agent for maintaining the trivalent chromium ions in solution, wherein the aqueous acidic trivalent chromium electrolyte further comprises a dispersion of colloidal silica.

2. The electrolyte according to claim 1, wherein the colloidal silica has an average particle size of between about 1 and about 100 nm.

3. The electrolyte according to claim 2, wherein the colloidal silica has an average particle size of between about 10 and about 40 nm.

4. The electrolyte according to claim 1, wherein the concentration of colloidal silica in the electrolyte is between about 0.5 and about 150 g/l.

5. The electrolyte according to claim 4, wherein the concentration of colloidal silica in the electrolyte is between about 1 and about 20 g/l.

6. The electrolyte according to claim 1, wherein the pH of the electrolyte is between about 1 and about 4.

7. The electrolyte according to claim 1, wherein the electrolyte further comprises thiocyanate ions.

8. The electrolyte according to claim 1 wherein the electrolyte further comprises thiocyanate ions, iron ions or a combination of thiocyanate and iron ions.

9. The electrolyte according to claim 1, wherein the electrolyte further comprises a combination of thiocyanate ions and iron ions.

10. The electrolyte according to claim 1, wherein the electrolyte comprises a buffer material selected from the group consisting of founates, acetates, borates, bromides and combinations of one or more of the foregoing.

11. The electrolyte according to claim 1, wherein the electrolyte is capable of producing an electrodeposited chromium coating on a substrate having an L* value, measured according to an L*a*b* colorspace system, of less than 65; wherein L* represents the lightness of a sample on a scale of 0 to 100, a* represents how green to red the sample is on a −60 to 60 scale, and b* represents how blue to yellow the same is on a scale of −60 to 60.

* * * * *